US005534304A

United States Patent [19]

Geursen et al.

[11] Patent Number: 5,534,304

[45] Date of Patent: Jul. 9, 1996

[54] PROCESS FOR TREATING A SUBSTRATE WITH A SUPERABSORBENT MATERIAL

[75] Inventors: Herman J. Geursen, Rozendaal; Stephanus Willemsen, Rheden, both of Netherlands

[73] Assignee: Akzo Nobel NV, Arnhem, Netherlands

[21] Appl. No.: 295,883

[22] PCT Filed: Mar. 12, 1993

[86] PCT No.: PCT/EP93/00600

§ 371 Date: Oct. 21, 1994

§ 102(e) Date: Oct. 21, 1994

[87] PCT Pub. No.: WO93/18223

PCT Pub. Date: Sep. 16, 1993

[30] Foreign Application Priority Data

Mar. 13, 1992 [NL] Netherlands ..... 9200472

[51] Int. Cl.[6] ..... B05D 3/02; B05D 7/02

[52] U.S. Cl. ..... 427/389.9; 427/121; 427/392

[58] Field of Search ..... 427/389.9, 388.4, 427/392, 118, 121, 434.6

[56] References Cited

U.S. PATENT DOCUMENTS

| | | | |
|---|---|---|---|
| 3,790,477 | 2/1974 | Nielsen et al. | 210/47 |
| 4,051,065 | 9/1977 | Venema | 252/359 A |
| 4,064,318 | 12/1977 | Sadowski | 428/543 |
| 4,070,321 | 1/1978 | Goretta et al. | 260/29.6 H |
| 4,075,144 | 2/1978 | Frisque et al. | 260/22 R |
| 4,078,133 | 3/1978 | Ozima | 526/80 |
| 4,079,027 | 3/1978 | Phillips et al. | 260/29.4 |
| 4,366,206 | 12/1982 | Tanaka | 428/373 |
| 4,493,772 | 1/1985 | Tanaka | 210/799 |
| 4,606,958 | 9/1986 | Haq et al. | 428/68 |
| 4,758,466 | 7/1988 | Dabi et al. | 428/283 |
| 4,798,744 | 1/1989 | Goldstein et al. | 427/389.9 |
| 4,837,077 | 6/1989 | Anton et al. | 427/389.9 |
| 4,888,238 | 12/1989 | Katz et al. | 427/212 |
| 4,944,963 | 7/1990 | Dabi et al. | 427/389.9 |
| 5,139,841 | 8/1992 | Makoui et al. | 428/109 |
| 5,218,011 | 6/1993 | Freeman | 523/173 |
| 5,264,251 | 11/1993 | Geursen et al. | 427/389.9 |
| 5,342,686 | 8/1994 | Geursen et al. | 428/378 |
| 5,432,000 | 7/1995 | Young, Sr. et al. | 428/372 |

FOREIGN PATENT DOCUMENTS

| | | |
|---|---|---|
| 0261000 | 3/1988 | European Pat. Off. . |
| 0314371 | 5/1989 | European Pat. Off. . |
| 0314991 | 5/1989 | European Pat. Off. . |
| 0351100 | 1/1990 | European Pat. Off. . |
| 0482703 | 4/1992 | European Pat. Off. . |
| 2154081 | 7/1972 | Germany . |
| 56-147630 | 11/1981 | Japan . |

OTHER PUBLICATIONS

Schäfer et al. "Swellable nonwovens for cables", *Wire Industry,* Oct. 1989, pp. 629–635.

P. K. Chatterjee, Ed., *Absorbency* (Amsterdam: Elsevier, 1985), p. 198 (no month).

P. Becher, *Emulsions, Theory and Practice,* 2nd edition (New York, Reinhold Publishing Corp., 1965) pp. 230–255 (no month).

Kirk–Othmer, *Encyclopedia of Chemical Technology,* 3rd Edition, vol. 3 (1978), pp. 213–242 (no month).

*Research Disclosure,* No. 333 (Jan. 1992), Disclosure No. 33366.

Derwent Abstract No. 92–239582 of JP 4163397, Jun. 1992.

Derwent Abstract No. 89–297971 of JP 1221575, Sep. 1989.

Derwent Abstract No. 91–278434 of JP 3185166, Aug. 1991.

*Primary Examiner*—Diana Dudash

*Attorney, Agent, or Firm*—Louis A. Morris; Joseph M. Noto

[57] ABSTRACT

Process for treating a substrate, namely a fibre or a fibrous product, with a superabsorbent material, in which process there is applied to the surface of the substrate, which is not an aramid fibre, a layer of a water-in-oil emulsion which contains a superabsorbent material in its aqueous phase, so that there is applied to the substrate, calculated on its dry weight, 0.3 to 40 wt. % of the superabsorbent material, after which the liquid constituents of the emulsion are wholly or partially removed from the substrate.

14 Claims, 2 Drawing Sheets

PROCESS FOR TREATING A SUBSTRATE WITH A SUPERABSORBENT MATERIAL

The invention relates to a process for treating a substrate, namely a fibre or a fibrous product, which is not an aramid fibre, with a superabsorbent material, by applying to the surface of the substrate a layer of a water-in-oil emulsion which contains a superabsorbent material in its aqueous phase, and subsequently wholly or partially removing the liquid constituents of the emulsion from the substrate.

Such a process is known.

U.S. Pat. No. 4,798,744 discloses a method of making superabsorbent fibrous porous support by impregnation of a porous support with a reverse suspension or emulsion. Said reverse suspension or emulsion results from the polymerization reaction and the removal of solvent from the support. The porous support can be a non-woven material, paper, fibre pile or a foam, of which the porosity is preferably greater than 0.5. Cellulose fibres are mentioned. The fibres treated are meant to comprise as much absorbent material as possible, so that the absorbent capacity is as large as possible. The superabsorbent material consists of a mixture of polyacrylic acid and an alkali acrylate, and a surfactant having an HLB value of 8–12.

U.S. Pat. No. 4,888,238 discloses a method of making superabsorbent synthetic fibres of which the surface is coated with a layer of superabsorbent polymer. As synthetic fibres suitable to be used are mentioned fibres of polyester, polyolefin, polyacrylonitrile, polyamide, rayon, cellulose acetate, dacron, and nylon, as well as bicomponent fibres. The fibres to be treated are added to an aqueous solution of an anionic polyelectrolyte, a polyvalent metal salt, and an ammonium compound as neutralising agent. Next, the thus impregnated fibres are dried in a stream of air, the neutralising agent evaporating and the polyelectrolyte complexing on the fibre surface. The thus formed complex decomposes at a pH of higher than 7. The method can only be used on short fibres.

EP Patent Application 0 314 371 discloses a non-woven of continuous polyester fibres treated with a superabsorbent material. The nonwoven's treatment consists in its being impregnated with a mixture of the superabsorbent material and water. The superabsorbent material is polyacrylic acid or polyacrylamide or salts thereof. Also, mixtures or copolymers of said compounds may be employed.

According to EP Patent Application 0 351 100, Kevlar®, a commercially available aramid yarn, is impregnated with a superabsorbent material. After being impregnated the treated yarn is dried, so that a film is formed in and around the yarn's interstices. In one embodiment of this method, of treatment the yarn is impregnated with a superabsorbent material derived from an aqueous solution comprising an acrylate polymeric material which combines acrylic acid and sodium acrylate functionalities and water.

U.S. Pat. No. 4,366,206 discloses water-swellable fibres consisting of a sheath of hydrophilic cross-linked polymer and a core of an acrylonitrile polymer and/or another polymer. This product is made by subjecting fibres with a surface composed of polyacrylonitrile to such a treatment with a solution of an alkali hydroxide in water as will give a fibre with a cross-linked hydrophilic outer layer.

Wire Industry, October 1989, pp. 629–635, discloses the use in cables of swellable yarns and non-woven tapes composed of two or more layers of a synthetic fibres structure with a swellable powder embedded therein. The backing layer is composed of a thermally bonded non-woven of polyethylene terephthalate. The cover layer may contain a proportion of cellulose fibres.

EP Patent Application 0 314 991 discloses communications cables provided with a water blocking tape consisting of a non-woven of polyethylene terephthalate, nylon, glass or polypropylene impregnated with a mixture of a superabsorbent material and water. The superabsorbent material is polyacrylic acid or polyacrylamide or salts thereof. Also, mixtures of copolymers of said materials may be employed.

EP Patent Application 0 216 000 describes an optical fibre cable provided with a water blocking means consisting of an inert base with a coating layer of a water absorbing and swelling material provided thereon. The base is a tape, braid or film of polyethylene, polyethylene terephthalate, polyvinyl chloride or aluminium. The water absorbing and swelling coating layer may be composed of minute particles of any substance which is water-soluble and capable of absorbing 10 to 100 times its own weight in water, more particularly a copolymer of acrylic acid salt, acrylic acid, and acrylonitrile. The particles are embedded in rubber or in a synthetic resin. The water absorbing, and swelling coating layer is formed by impregnating the base with a mixture composed of the particles of the water absorbing and swelling material and a solution of a rubber or synthetic resin in an organic solvent, and then drying the material so treated.

Japanese Patent Application 147630/81 describes a method of incorporating a highly water absorptive cross-linked polyacrylate in a water-insoluble substrate, which may be composed of fibres or some other material. The water absorbing polyacrylate is prepared by successively suspending an aqueous solution of the monomer in a hydrocarbon medium, subjecting the mixture to reverse phase suspension polymerisation, and evaporating the hydrocarbon. The resulting powdered solid is mixed with the substrate, optionally with water being added.

Non-prepublished Netherlands Patent Application 9 002 337 relates to an aramid yarn provided with a superabsorbent material. Such a yarn may be made by applying to the surface of an aramid yarn a layer of a water-in-oil emulsion containing a superabsorbent material in its aqueous phase, and then removing the liquid constituents of the emulsion wholly or in part from the yarn by means of evaporation. The known prior art methods of applying a superabsorbent material to the surface of a fibre or a product manufactured therefrom are attended with drawbacks.

Several of the aforementioned known processes require the use of substances which are aggressive and/or environmentally harmful. The drawback of applying as much absorbent material on the fibrous support is that the support no longer can be applied in several fields, because of the volume and the weight of the treated support. Furthermore, in U.S. Pat. No. 4,798,744, the support is humidified prior to applying the superabsorbent. By such humidification, the superabsorbent material is reversed on the support and so instabilised. The waterblocking capacity of such a material is diminished. Furthermore, the superabsorbent emulsions and suspensions mentioned in U.S. Pat. No. 4,798,744 are found to be instable due to the emulsifier used.

The drawback to impregnating a substrate with a superabsorbent material dispersed in an aqueous system is that, due to the superabsorbent material's high viscosity-enhancing action, steady feeding of it is extremely difficult if not impossible. Further, on account of the restricted superabsorbent concentration in the impregnating liquid only a small quantity of superabsorbent material can be applied to the yarn per treatment. Another drawback to this method is that the comparatively large amount of impregnating liquid which is applied to the substrate with the superabsorbent material has to be removed by evaporation.

Mixtures of an organic liquid with dispersed therein solid particles of a superabsorbent material which is insoluble in said liquid generally are not very stable, so rendering it difficult if not downright impossible to turn it into end products with homogeneous properties.

The disadvantage of handling superabsorbent materials in the powdered form is that special equipment is required and that, furthermore, it is hard to distribute the powdered material evenly over the substrate. An additional drawback to handling powders is that dust is raised, with the attendant risk of explosions and health hazards.

The present invention obviates the aforementioned drawbacks.

The invention consists of a process for treating a substrate, namely a fibre or a fibrous product, which is not an aramid fibre, with a superabsorbent material, by applying to the surface of the substrate a layer of a water-in-oil emulsion which contains a superabsorbent material in its aqueous phase, and subsequently wholly or partially removing the liquid constituents of the emulsion from the substrate, the process being characterised in that there is applied to the substrate, calculated on its dry weight 0.3 to 40 wt. % of the superabsorbent material. The process according to the invention makes it possible to produce high quality fibres and fibrous products having superabsorbent properties in a simple and economical manner. The amount of superabsorbent material on the substrate is selected such as to give the product the water absorbing properties desired for the envisaged application. Preferably, 0.5 to 20 wt. %, more particularly still 0.5 to 10 wt % of the superabsorbent material, calculated on its dry weight, is applied to the substrate.

By a superabsorbent material is meant, within the scope of the invention, a water-soluble or water-insoluble material having hydrophilic properties which is capable of absorbing and holding a comparatively large quantity of water, optionally under pressure. Hence, in addition to the insoluble superabsorbent materials mentioned in P. K. Chatterjee, Ed., Absorbency (Amsterdam: Elsevier, 1985), p. 198 and in EP Patent Application 0 351 100 there may also be employed according to the present invention superabsorbent materials which are wholly or partially water-soluble.

In the process according to the invention preference is given to the use of superabsorbent materials from which stable water-in-oil emulsions can be prepared. Especially suitable are superabsorbent derivatives of polyacrylic acid. These include the homo- and copolymers derived from acrylamide, acrylamide and sodium acrylate, and acrylamide and dialkylaminoethyl methacrylate. These compounds belong to the groups of non-ionic, anionic, and cationic (co)polymers, respectively. In general, they are prepared by linking of the monomer units to form a water-soluble polymer. This can then be rendered insoluble by ionic and/or covalent cross-linking. Examples of superabsorbent materials that may be employed in the process according to the invention include: cross-linked polyacrylic acid partially neutralised into the sodium salt, polypotassium acrylate, copolymers of sodium acrylate and acrylamide, terpolymers of acrylamide and carboxyl groups- and sulpho groups-containing monomers (sodium salt), polyacrylamide polymers. Preferably, use is made of a terpolymer of acrylamide and carboxy groups- and sulpho groups-containing monomers (sodium salt) or of a polyacrylamide copolymer.

Using the process according to the invention the superabsorbent material is applied to the substrate via a water-in-oil emulsion, the superabsorbent material being present in the aqueous phase of the emulsion.

The preparation of such an emulsion is as follows: with the aid of an emulsifier a water-soluble monomer admixed with a quantity of water is dispersed in a non-polar solvent immiscible with water and the monomer, and then polymerised to form a water-in-oil emulsion. The polymer formed is in the aqueous phase of the emulsion. In this manner a liquid product is obtained which contains a high concentration of the superabsorbent material, while the liquid's viscosity remains low. Such emulsions and their preparative processes are known in themselves. For the water-soluble superabsorbent materials reference is made to the descriptions in, int. al., U.S. Pat. Nos. 4,078,133, 4,079,027, 4,075,144, 4,064,318, 4,070,321, 4,051,065, and German Auslegeschrift 21 54 081; water-insoluble superabsorbent materials are described in Japanese laid-open Patent Application No. 147630/81.

As continuous oil phase of the emulsion may be used liquids which are immiscible or poorly miscible with water, such as linear, branched, and cyclic hydrocarbons, aromatic hydrocarbons, chlorinated hydrocarbons, etc. It is less desirable to have high boiling liquids since it is difficult to remove them from the fibre by means of evaporation. Preferably, linear, branched, and cyclic hydrocarbons are employed, or else petroleum fractions which are substantially made up of a mixture of such hydrocarbons and have a boiling point in the range of 150° to 250° C.

The selection of the emulsifiers employed is such as will permit the conversion of said mixture into a water-and-oil emulsion. Therefore, the emulsifier should have an HLB (hydrophilic-lipophilic balance) value in the range of 3 to 6. With emulsifier is meant one ore more emulsifiers. In case the emulsifier used has a HLB value that is much higher, the emulsion obtained will be much less stable.

The concentration of the superabsorbent material in the emulsion used according to the invention is 1–90%, preferably 2–50%, calculated on the overall weight of the emulsion.

The commercially available water-in-oil emulsions which contain a superabsorbent material generally have a solids content of 20 to 70 wt. %. In the process according to the invention such products may be employed either as such, i.e. undiluted, or in combination with additives such as lubricants, stabilisers, emulsifiers and/or diluents.

As examples of materials suitable for use as emulsifier and as lubricant may be mentioned ethoxylated oleyl alcohol and ethoxylated oleic acid.

Examples of materials suitable for use as diluent include non-aromatic naphthenic and (iso)paraffinic hydrocarbons having a boiling point in the range of 150° to 280° C. and isohexadecane, notably hydrogenated tetraisobutylene.

To enhance their stability the dilute water-in-oil emulsions may contain 5–100 wt. %, preferably 20–80 wt. %, calculated on the undiluted emulsion, of one or more special stabilisers. These stabilisers should have an HLB value of less than 5. The meaning of the HLB (hydrophile-lipophile balance) value has been described in P. Becher, *Emulsions, Theory and Practice,* 2nd edition (New York: Reinhold Publishing Corp., 1965), pp. 232–255.

Examples of suitable stabilisers include sorbitan trioleate, mixtures of sorbitan trioleate and ethoxylated sorbitan trioleate, sorbitan mono(iso)stearate, and sorbitan monooleate. Materials with higher HLB values will generally give water-in-oil emulsions of inferior stability.

The stabilisers incorporated into the emulsion also have the favourable property of preventing the substrate from becoming electrostatically charged, so that filament spreading and filamentation of the fibres are avoided.

The viscosity of the commercially available water-in-oil emulsions is significantly reduced by their being diluted. As a result, it becomes possible to apply the superabsorbent material-containing water-in-oil emulsion to the substrate by means of a kiss roll. If so desired, the water-in-oil emulsions may contain the conventional additives such as bactericides and anti oxidants.

In the process according to the invention the water-in-oil emulsion may be applied using methods known in themselves, e.g. via a finishing bath, a kiss roll or a liquid applicator. When treating substrate which are substantially twodimensional in shape such as non-wovens, woven fabrics, and knitted fabrics, techniques known from textile dying such as mercerization and pressing, spreading, spraying, and atomising are especially eligible to be used. These and other techniques are known to the skilled man and have been described in such manuals of instruction as M. Peter and H. K. Rouette, *Grundlagen der Textilveredlung,* 13th impression (Deutscher Fachverlag, 1989), pp. 187–489, 505–507, 707–709.

Following the application of the water-in-oil emulsion the non-polar solvent present in the emulsion and the water are wholly or for the most part removed from the substrate leaving a homogeneous layer of superabsorbent material on the substrate.

The solvent and the water are preferably removed by means of evaporation. To this end the treated substrate is subjected to a drying process.

Drying is carried out by the conventional methods, in which use may be made of means such as hot drums, hot sheets, hot rollers, hot gases, tube ovens, steam boxes, infra-red radiators, and the like. The drying temperature is 50° to 300° C., preferably 100° to 250° C.

The dried material can optionally be wetted with a small quantity of water, say 5–50 wt. %, and redried in order to further improve its water blocking capacity. This procedure may be repeated several times if so desired.

The process according to the invention may be carried out in various ways.

If the substrate is a fibre, the water-in-oil emulsion containing the superabsorbent material can be applied to the spun fibre in a fully continuous manner and directly coupled to the fibre spinning process, optionally after the fibre has been washed, dried and/or drawn. The thus treated fibre is then dried.

According to another embodiment, the fibre is treated with the superabsorbent material present in a water-in-oil emulsion in a separate process not integrated with the spinning process.

The process according to the invention is especially suited to be used for combining, in one and the same process pass, the production of a substrate or some aftertreatment thereof, say a drawing and/or heat treatment to improve its mechanical properties, with the treatment of the substrate according to the invention.

The process according to the invention may be used on substrates of fibres or fibrous products of a wide-ranging composition, with the proviso that aramid fibres in so far as they are the subject of the invention described in Netherlands Patent Application 9002337 are excluded.

As suitable types of fibres may be mentioned fibres of organic as well as inorganic origin. The fibres of organic origin may be either natural or synthetic. Examples of natural fibres include cellulose fibres such as cotton, linen, jute, etc., and fibres of animal origin such as wool, silk, etc. Examples of synthetic organic fibres include fibres of regenerated cellulose, rayon, polyesters, aliphatic polyamides, acrylonitrile, polyolefins, polyvinyl alcohol, polyvinyl chloride, polyphenylene sulphide, elastomers, and carbon. Examples of inorganic fibres include fibres of glass, metals, silica, quartz, etc., ceramic fibres, and mineral wool. In addition, fibres made up of mixtures of said materials or copolymers thereof or mixtures of said fibres may be employed. The aforementioned types of fibres and other ones suitable for use in the process according to the invention have been described in Kirk-Othmer, *Encyclopedia of Chemical Technology*, 3rd Edition, Vol. 10 (1980), pp. 148–197.

Preference is given to fibres composed of polyethylene terephthalate, nylon-6, nylon-6, 6 or regenerated cellulose.

Also highly suitable as a substrate are fibres composed of two or more of the aforementioned materials, e.g. bicomponent fibres. They may be of the sheath-core or the side by side type, or of some other well-known type.

Other suitable types of fibres are satellite fibres and split fibres. The fibres may De either solid or hollow. They may be round or flat or of any other desired cross-sectional shape, e.g. elliptical, triangular, star-shaped, kidney-shaped, etc.

Also eligible as a substrate are all fibrous products, including non-wovens, manufactured from the aforementioned fibres. Examples of such fibrous products include non-wovens, knitted fabrics, woven fabrics, braids, ribbon, gauze, paper, etc., and laminates and composites made therefrom.

The process according to the invention is highly suited to be used for the treatment of non-wovens. As non-wovens may be used all products so defined in international standard ISO 9092 (1988). Especially suitable are non-wovens composed of bicomponent fibres of the sheath-core type. Preferably, the substrate is a non-woven of bicomponent fibres having a sheath of nylon-6 and a core of polyethylene terephthalate.

Within the framework of the invention the term fibres refers to endless filaments as well as shorter fibres and also to fibrids, fibrils, pulp, microfibres, and mixtures of said types of fibres. They are treated as such or in the form of a fibrous product made up of one or more of the aforementioned types of fibres.

The fibres obtained according to the invention may have any linear density common in actual practice, and yarns may be made up of any desired number of endless filaments. Generally, the fibres or the yarns composed of said fibres will have a linear density of 0.01 to 20 000 dtex, while the endless filament yarns will be composed of 1 to 20 000 filaments.

The application of the superabsorbent material to the substrate according to the invention does not have a negative effect on the substrate's principal mechanical properties.

The water content of the substrate treated using the process according to the invention does not, after drying, differ significantly from that of the corresponding substrate not treated with a superabsorbent material, nor does it do so after its subsequent lengthy exposure to the air. Apparently, the superabsorbent material present on the surface of the product obtained according to the invention absorbs only a small quantity of the water vapour present in the air. It is only when the product is contacted with water in the liquid form that it absorbs a large quantity thereof and so swells. Serving as a measure of the quantity of water absorbed by the product according to the invention when contacted with water in the liquid form is the swelling value. The method of experimentally determining the swelling value is described in further detail below.

The process according to the invention makes it possible to prepare products of high swelling value. Depending on the nature of the substrate and the quantity and nature of the superabsorbent material applied thereto, the swelling value ranges from 50 to 700 or higher, more particularly from 100 to 700 or higher.

The procedure to determine the swelling value of the product obtained according to the invention is as follows.

If the material to be examined consists of a yarn or loose fibres, about 10 g thereof are cut into non-intertwisted fibres of some 12 cm in length. Needless to say, such cutting may be omitted if the product is made up of fibres of a shorter length than about 12 cm.

If the material to be examined consists of a substantially two-dimensional fibrous product such as a non-woven, woven fabric, knitted fabric, etc., about 10 g thereof are cut into strips of approx. 1–12 cm in length and 0.5–1.0 cm in width.

The thus treated sample is immersed completely, without stirring, in 600 ml of demineralised water of 20°–22° C. in an 800 ml beaker. For 60 seconds (measured by Stopwatch) the sample remains immersed in the water in a condition of complete rest, i.e. without being stirred, shaken, vibrated, or subjected to any other form of movement. Immediately afterwards the entire contents of the beaker, i.e. sample and water, are transferred to a bag (dimensions: about 10 cm×15 cm) made of polyester curtain netting (mesh size 1.5 mm×1 mm). In this process the water for the most part runs out through the meshes of the curtain netting, while the sample is left in the bag. Next, the bag and its contents are straightaway transferred to a centrifuge and then centrifuged for 120 seconds (measured by stopwatch), thus removing the still adhering water from the soaked sample. The centrifuge used is an AEG of the type SV 4528 (ex AEG Aktiengesellschaft, D-8500 Nuremberg), operates at a rate of 2800 revolutions per minute, and has a centrifugal drum with an inner diameter of about 24 cm. Immediately after it has been centrifuged the sample is transferred from the bag to a weighing box with a pair of tweezers and weighed to an accuracy of 0.0001 g (sample weight: a grammes). The sample in the weighing box is thereupon dried to constant weight in an air oven at 105° C. Usually a drying time of 24 hours will suffice. After that the weight of the dried sample in the weighing box is determined to an accuracy of 0.0001 g (sample weight: b grammes).

The swelling value of the product is calculated by means of the following formula:

$$\text{swelling value} = \frac{(a-b)\cdot 100}{b}.$$

Each determination is carried out in duplicate and the results are averaged.

On account of the properties mentioned hereinbefore the products made using the process according to the invention are pre-eminently suited to be used as a reinforcing member with water absorbing and/or water blocking capacities. Consequently, the products obtained according to the invention may be used as sealing tapes, packings, roofing material, geotextiles, filter material for filtering oil which contains water, e.g. demisting diesel fuel, as a medium for drying wet gases, fire blankets, sealing material for ponds, as slow release medium, e.g. for the slow feeding of fertiliser to the soil, as temporary sealing layer in the production of foamed products such as foamed composites, as moisture-absorbing medium in cables, more particularly electrical and optical communications cables, and in all other cases in which the special properties of the products obtained according to the invention are of use. For examples of possible applications reference is made to *Research Disclosure*, No. 333 (January 1992), Disclosure No. 33366.

BRIEF DESCRIPTION OF THE DRAWINGS

FIG. 1 shows a front view/cross-section of the testing apparatus, FIG. 2 a top view.

Figure 1:
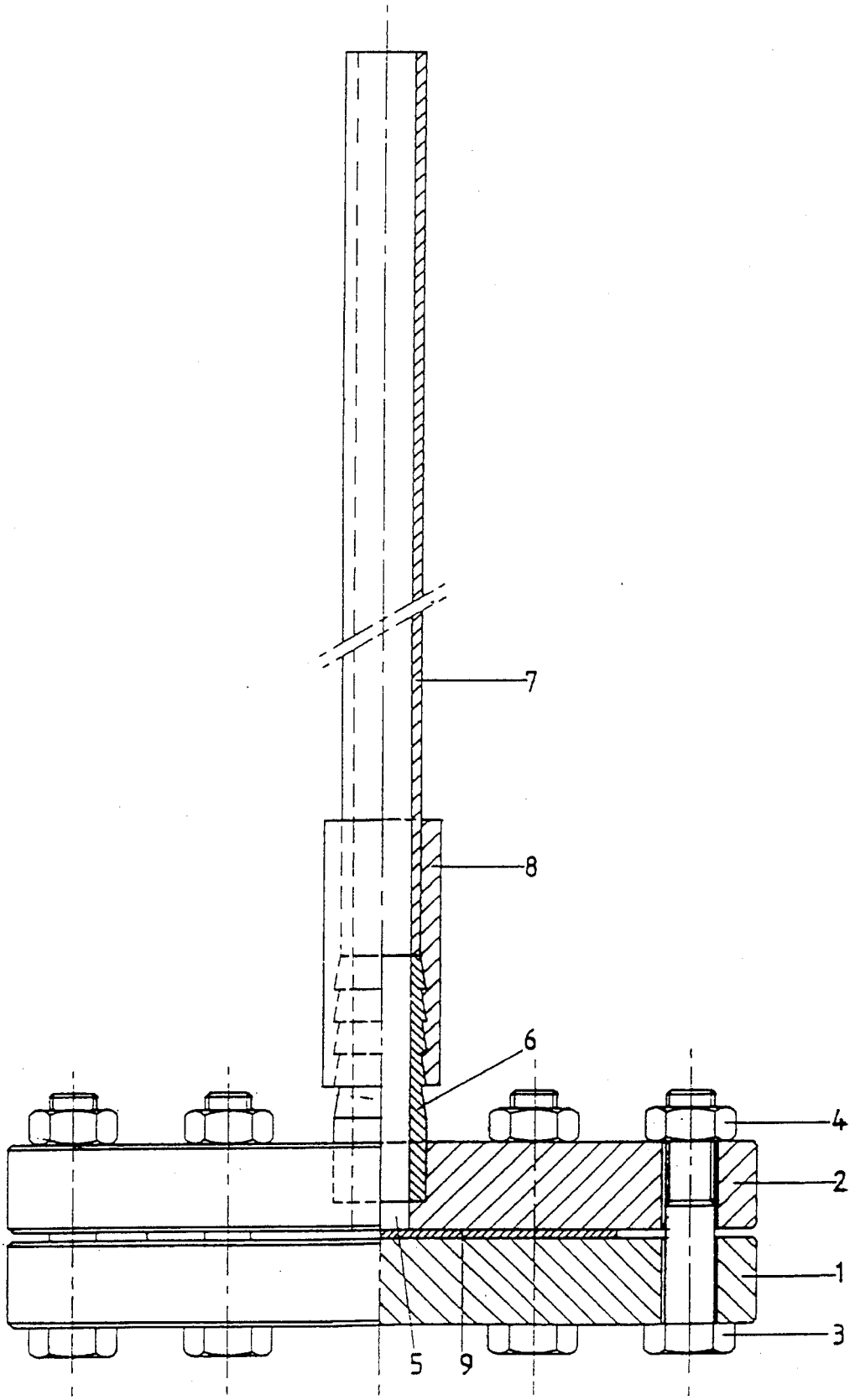
FIGS. 1 and 2 attached to this description relate to a testing apparatus which may be used to test the water blocking capacity of products of a substantially two-dimensional structure manufactured according to the invention.
Figure 2:
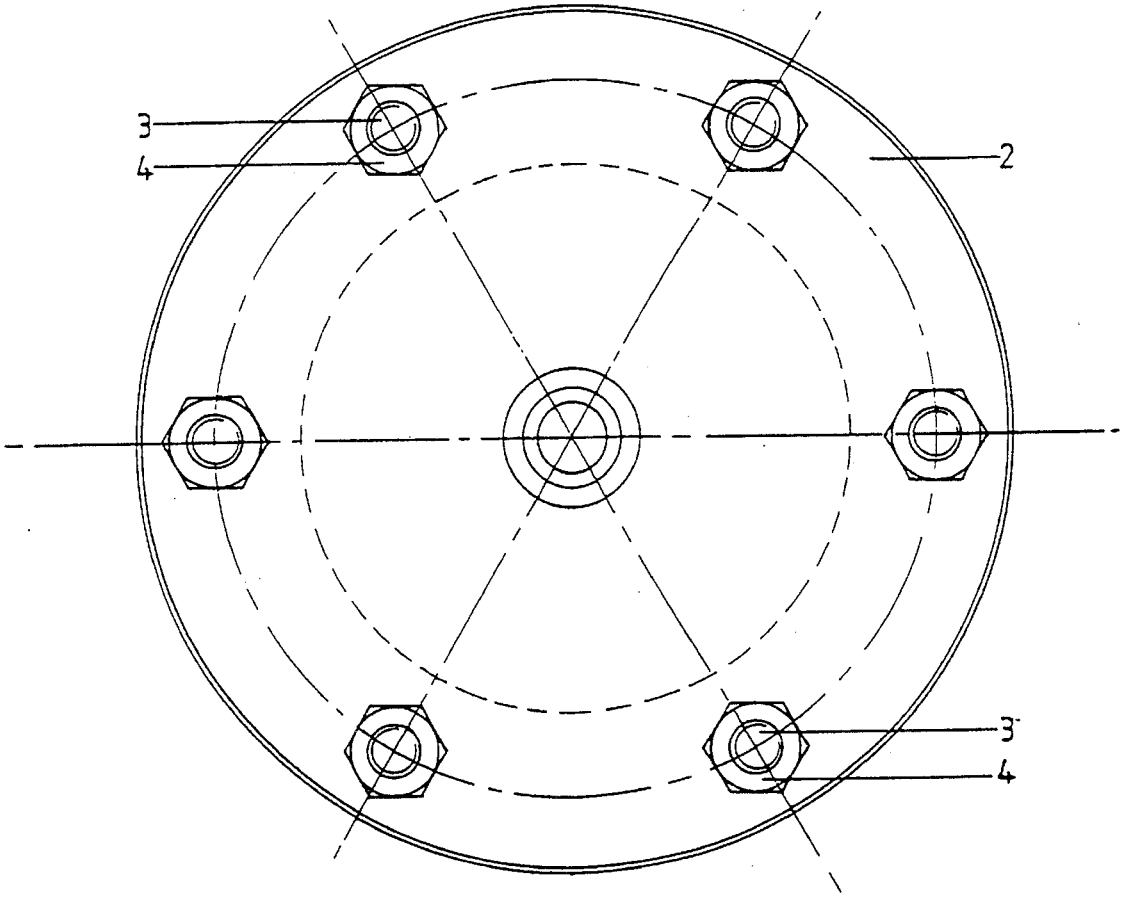

The apparatus illustrated in FIGS. 1 and 2 is described in greater detail in one of the following examples, with reference to which the invention will be further elucidated.

EXAMPLE I

At a yarn rate of 20 m/min and using a geared feed pump and a split applicator an untwisted filament yarn of polyester composed of poly(p-phenylene terephthalate) with a linear density of dtex 1100 f 210 was provided with a water-in-oil (W/O) emulsion. The emulsion contained in its aqueous phase a material having superabsorbent properties. Next, the yarn was dried with the aid of a tube oven (temperature: 225° C.) and a hot sheet (temperature: 130° C.). The residence time in the tube oven and on the hot sheet was about 2 and about 4 seconds, respectively.

The water blocking action of the resulting yarn was determined using the yarn through-flow test. In this test the inner cylindrical space of a section of PVC (polyvinyl chloride) hose open on both sides is filled with a bundle of the yarn, such that the longitudinal axis of the yarn bundle is substantially parallel to the longitudinal axis of the cylindrical space in which the yarn bundle is arranged. The hose filled with the yarn is cut through in a direction perpendicular to its longitudinal axis in two places, such that a cylinder-shaped test tube of a length of 50 mm is formed and the ends of the yarn bundle present in the thus obtained test tube by and large coincide with the test tube ends. Next, one of the ends of the test tube is contacted with the contents of a vessel of liquid and subjected to the pressure of a column of water of a particular height. The time required to wet the entire yarn bundle in the test tube is referred to as the through-flow time. This time is a measure of the water blocking action of the yarn. The through-flow time is taken to be the time which passes after the application of water pressure to the one end of the test tube and prior to the first drop appearing at the other (free) end.

The through-flow test is carried out under the following conditions:

| | |
|---|---|
| Type of hose | polyvinyl chloride |
| Hose, inner diameter | 5 mm |
| Hose, outer diameter | 7 mm |
| Length of test tube | 50 mm |
| Number of yarns in test tube | such as will give the bundle a linear density of dtex 168 000 |
| Height of liquid head | 100 cm |
| Testing liquid | demineralised water |

The number of yarns in the test tube should be chosen such that the bundle formed from them will fully fill the internal cylindrical space of the test tube. This was found to be the case for an overall linear density of the yarn bundle of dtex 168 000.

The composition of the water-in-oil emulsions with which the polyester yarn was treated was as follows.

| | |
|---|---|
| Mirox W 45985 (32.5%) | 70 parts by weight |
| Span 85 | 10 parts by weight |
| Exxsol D80 | 20 parts by weight |

Mirox W 45985 is a terpolymer of acrylamide, carboxyl groups-, and sulpho groups-containing polymers (sodium salt) as water-in-oil emulsion in paraffinic hydrocarbons having a viscosity of 273 $mm^2/s$ (measured with an Ubbelohde viscometer at 25° C.). It was supplied by Chemische Fabrik Stockhausen GmbH, D-4150 Krefeld 1, Federal Republic of Germany.

Span 85 is sorbitan trioleate, supplied by ICI Holland B. V.

Exxsol D80 is a mixture of non-aromatic naphthenic and (iso)paraffinic hydrocarbons with an atmospheric boiling range of 196° to 237° C., supplied by Exxon Chemical Holland B. V.

The results of the tests are listed in Table A

TABLE A

| Exp. no. | Amount of super-absorbent on yarn (wt. %) | Through-flow time (100 cm water column) | Swelling value |
|---|---|---|---|
| 1 | 2.1 | >25 days | 114 |
| 2 | 3.5 | >4 days | 144 |
| 3 | 7.0 | >29 days | 171 |

The through-flow time of the starting yarn, which was not treated with the superabsorbent-containing water-in-oil emulsion, was less than 1 minute. This untreated yarn had a swelling value of 9.

It is clear from the data in Table A that the process according to the invention permits the manufacture of a polyester yarn which has a high water absorbing capacity and, under the conditions of the through-flow test, is capable of withstanding water at a pressure of 1 m water head for more than 29 days.

EXAMPLE II

An untwisted filament yarn of aliphatic polyamide composed of nylon-6, 6 with a linear density of dtex 940 f 140 was treated with a water-in-oil emulsion of a superabsorbent material. The process and the water-in-oil emulsion were as described in Example I. The results of the tests are listed in Table B.

TABLE B

| Exp. no. | Amount of super-absorbent on yarn (wt. %) | Through-flow time (100 cm water column) | Swelling value |
|---|---|---|---|
| 4 | 2.1 | >29 days | 115 |
| 5 | 3.5 | >5 days | 154 |
| 6 | 7.0 | >5 days | 193 |

The through-flow time of the starting yarn, which was not treated with the superabsorbent-containing water-in-oil emulsion, was less than 2 minutes. This untreated yarn had a swelling value of 11.

It is clear from the data in Table B that the process according to the invention permits the manufacture of an aliphatic polyamide yarn which has a high water absorbing capacity and, under the conditions of the through-flow test, is capable of withstanding water at a pressure of 1 m water column for more than 29 days.

EXAMPLE III

An untwisted filament yarn of rayon (regenerated cellulose) having a linear density of dtex 1220 f 720 was treated by the process as given in Example I, with the proviso that the water-in-oil emulsion with which the yarn was treated was made up of undiluted Mirox W 45985 (32.5%).

The results of the tests are compiled in Table C.

TABLE C

| Exp. no. | Amount of super-absorbent on yarn (wt. %) | Through-flow time (100 cm water column) | Swelling value |
|---|---|---|---|
| 7 | 2 | >4 days | 199 |
| 8 | 5 | >4 days | 407 |
| 9 | 10 | >4 days | 629 |

The starting yarn, which was not treated with the superabsorbent-containing water-in-oil emulsion, had a swelling value of 86. Although the through-flow time of this untreated rayon yarn was more than 5 days, the yarn bundle in the test tube was fully wetted in the process. It was found for the experiments 7–9 that such wetting did not occur in the case of the yarn treated according to the invention.

EXAMPLE IV

In this example the use of a non-woven as substrate is demonstrated. Use was made of a non-woven supplied as a commercial product by Akzo Fibers and Polymers Division, Industrial Nonwovens, Arnhem, the Netherlands, under the name of Colback® S 175. The non-woven i s composed of thermally bonded bicomponent yarn of the sheath-core type, with the sheath being made of nylon-6 and the core being of polyethylene terephthalate.

Using an atomiser a strip of the non-woven of the order of about 10 cm×20 cm was sprayed with a water-in-oil emulsion. The emulsion contained in its aqueous phase a material having superabsorbent properties. The composition of the water-in-oil emulsion was the same as that given in Example I, with the proviso that said emulsion was so diluted with Exxsol that its content was about 5 wt. %.

The dilute water-in-oil emulsion was introduced into the storage vessel of the atomiser (Zerstäuberaufsatz type category no. 5.4700.04, Lenz-Labor Instruments, Haarlem, the Netherlands ) and then sprayed uniformly over both sides of the non-woven with the aid of compressed air (superatmospheric pressure ca. 0.5 bar). The amount of emulsion applied was chosen such as to give a non-woven containing 2.5 wt. % of the superabsorbent material, calculated on the weight of the dry non-woven.

The thus wetted non-woven was next dried in a pre-heated forced-circulation air oven at 175° C. The residence time in the oven was 10 minutes.

The dried product had a swelling value of 62.

The untreated substrate had a swelling value of 5.9.

The water blocking action of the dried product was determined using the through-flow test for two-dimensional products. In this test a disc-shaped sample of the material to be tested is clamped centrally between the smooth, flat surfaces of two disc-shaped sheets of a transparent plastics material. One of the sheets is drilled through at the centre to form a channel of which one end is bounded by the sample while the other is connected to a vessel of liquid filled with water. To carry out this test use is made of the apparatus depicted in FIGS. 1 and 2. In the left-hand part of FIG. 1 the testing apparatus is shown in front view, the right-hand part depicts a vertical cross-section across the centre. FIG. 2 shows the apparatus in top view. The apparatus is made up of two disc-shaped flanges of transparent plastics material, i.e. bottom flange 1 and top flange 2, centred one on top of the other. The two flanges have a diameter of 126 mm and are kept pressed together by six symmetrically arranged bolts 3 onto which nuts 4 are screwed. At the centre of top flange 2 is a drilling through 5, which at its top is connected to a tubular connector 6, which is fastened with glue in drilling through 5 of top flange 2. At its top, connector 6 is connected to a vertical glass standpipe 7. A sleeve 8 provides a connection which is watertight to the surrounding area between the connector 6 and standpipe 7. Between the flanges 1 and 2 a disc-shaped sample 9 of the material to be tested is centrally positioned. The diameter of the sample 9 is 80 mm.

The water blocking capacity of a test material is determined as follows.

A disc-shaped sample of 80 mm in diameter is cut off the material to be tested. This sample is placed in the testing apparatus as indicated in FIGS. 1 and 2. After centering of the sample, which is indicated with 9, between the flanges i and 2, the six nuts 4 are screwed onto the bolts 3 and tightened with a fixed moment using a Torqueleader type Minor fixed torque spanner of MHH Engineering Co. Ltd. The torque spanner is set to a moment of 230 cN.m ±5%. The thickness of the sample 9 should be such that after it has been mounted in the aforedescribed manner, the width of the air gap between the flanges 1 and 2 should be at least 0.15 mm measured at their outer circumference. If the sample's layer thickness is insufficient, several discs of the material to be tested are stacked one on top of the other until the minimum gap width required after mounting is obtained. Next, the standpipe 7 is connected to the connector 6 by means of the sleeve 8. The standpipe 7 is then filled from above with water to a height of 100 cm, measured from the sample 9. As a result, the sample 9 is subjected to a water pressure of 100 cm water column, and the water starts to travel from the centre through the sample in lateral direction. This process can be observed through the transparent material of the flanges 1 and 2. Depending on the magnitude of the test sample's water blocking capacity, this water displacement will either be halted or continue. In the latter case, water will become visible at the circumference of the gap-shaped space between the flanges 1 and 2. The through-flow time is taken as a measure of the tested material's water blocking capacity. By the through-flow time is meant, the time which passes after the standpipe 7 has been filled to the set height until the presence of leaked water becomes visible at the circumference of the gap between the flanges i and 2 of the testing apparatus.

The through-flow time of non-wovens manufactured using the process according to the invention is at least one day and preferably at least 10 days. Especially preferred are products which have a through-flow time of more than 50 days.

The through-flow time of the nonwoven manufactured as specified in the process of this example was in excess of 90 days.

A comparison sample composed of the untreated substrate had a through-flow time of less than 1 minute.

For each of the measurements of the above-mentioned through-flow times the sample consisted of two discs of the material to be tested stacked one on top of the other.

The very high water blocking capacity of the product manufactured according to the invention was found not to have deteriorated after a sample which had been subjected to the through-flow test was successively entirely wetted with water, dried at 115° C. for 15 minutes, and then again examined using the through-flow test. Even after this procedure had been repeated five times the result remained unchanged.

We claim:

1. A process for providing a non-aramid yarn with water-blocking properties comprising applying to the surface of the non-aramid yarn a layer of a water-in-oil emulsion which comprises a superabsorbent material in its aqueous phase, said superabsorbent material comprising 0.3 to 40 wt. % of said yarn based on the dry weight of said yarn, and subsequently wholly or partially removing the liquid constituents of the emulsion from the yarn.

2. The process of claim 1, wherein there is applied to the yarn, calculated on the dry weight of said yarn, 0.5 to 20 wt. % of the superabsorbent material.

3. The process of claim 2, wherein there is applied to the yarn, calculated on the dry weight of said yarn, 0.5 to 10 wt. % of the superabsorbent material.

4. The process of claim 1, wherein the water-in-oil emulsion further comprises an emulsifier having a HLB-value between 3 and 6.

5. The process of claim 1, wherein the water-in-oil emulsion further comprises 20–80 wt. %, calculated on the undiluted emulsion, of a stabilizer having an HLB-value of less than 5.

6. The process of claim 1, wherein the yarn comprises polyester yarn, aliphatic polyamide yarn, cellulose yarn, polyolefin yarn, polyacrylonitrile yarn, carbon yarn, glass yarn, metal yarn or mixtures thereof.

7. The process of claim 6, wherein the yarn is made up wholly or substantially of polyethylene terephthalate.

8. The process of claim 6, wherein the yarn is made up wholly or substantially of nylon-6, nylon 6, 6, or mixtures thereof.

9. The process of claim 6, wherein the yarn is made up wholly or substantially of regenerated cellulose.

10. The process of claim 6, wherein the yarn is a glass yarn.

11. The process of claim 1, wherein the yarn is a bicomponent yarn.

12. The process of claim 11, wherein the bicomponent yarn comprises a sheath of nylon-6 and a core of polyethylene terephthalate.

13. The process of claim 1, wherein said yarn is a filament yarn.

14. The process of claim 1, wherein said yarn is non-porous.

* * * * *